US007794076B2

(12) United States Patent
Nakano et al.

(10) Patent No.: US 7,794,076 B2
(45) Date of Patent: Sep. 14, 2010

(54) ULTRAVIOLET RAY IRRADIATION DEVICE, RECORDING APPARATUS USING THE ULTRAVIOLET RAY IRRADIATION DEVICE, AND RECORDING METHOD

(75) Inventors: Keitaro Nakano, Matsumoto (JP); Takashi Oyanagi, Shiojiri (JP); Kazushige Inoue, Okayama (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/962,931

(22) Filed: Dec. 21, 2007

(65) Prior Publication Data

US 2008/0174649 A1 Jul. 24, 2008

(30) Foreign Application Priority Data

Dec. 25, 2006 (JP) ..... 2006-348230
Jan. 12, 2007 (JP) ..... 2007-005018
Dec. 4, 2007 (JP) ..... 2007-313612

(51) Int. Cl.
*B41J 2/01* (2006.01)

(52) U.S. Cl. ..... 347/102; 347/101

(58) Field of Classification Search ..... 347/102, 347/101; 101/488; 219/216; 346/25
See application file for complete search history.

(56) References Cited

U.S. PATENT DOCUMENTS 7,232,212 B2 * 6/2007 Iwase ..... 347/102
2002/0034594 A1 * 3/2002 Shiveley ..... 427/558
2002/0044188 A1 * 4/2002 Codos ..... 347/106
2003/0035037 A1 * 2/2003 Mills et al. ..... 347/102
2003/0085974 A1 * 5/2003 Shimomura et al. ..... 347/101
2003/0222960 A1 * 12/2003 Takabayashi ..... 347/102
2004/0080598 A1 * 4/2004 Hasebe et al. ..... 347/102
2006/0121208 A1 * 6/2006 Siegel ..... 427/487

FOREIGN PATENT DOCUMENTS

JP 2004-237603 8/2004

* cited by examiner

*Primary Examiner*—Stephen D Meier
*Assistant Examiner*—Leonard S Liang
(74) *Attorney, Agent, or Firm*—Workman Nydegger

(57) ABSTRACT

The ultraviolet ray irradiation devices are attached to a carriage having a print head that ejects the ultraviolet curable ink, and include a plurality of ultraviolet light sources that irradiate ultraviolet rays onto ink coating ejected on a print sheet by the print head. An ultraviolet ray of the ultraviolet light source that irradiates the ultraviolet ray onto the print sheet in the vicinity of the print head has a wavelength shorter than an ultraviolet ray of the ultraviolet light source that irradiates the ultraviolet ray onto the print sheet apart from the vicinity of the print head along the moving direction of the carriage. The ultraviolet ray irradiation device is capable of sufficiently curing a plurality of ultraviolet curable ink adhered on a recording medium without incurring a problem of blurring or color mixing for a multiple-color printing process such as a full-color printing process.

13 Claims, 7 Drawing Sheets

ULTRAVIOLET RAY IRRADIATION DEVICE, RECORDING APPARATUS USING THE ULTRAVIOLET RAY IRRADIATION DEVICE, AND RECORDING METHOD

TECHNICAL FIELD

The present invention relates to an ultraviolet ray irradiation device having an ultraviolet light source that irradiates an ultraviolet ray onto ultraviolet curable ink ejected on a recording medium by a record head, a recoding apparatus using the ultraviolet ray irradiation device, and a recording method.

RELATED ART

Recently, as ink used for ink jet printers and the like, ultraviolet curable ink has attracted attention.

A difference between the ultraviolet curable ink and water-based ink or oil-based ink which is commonly used is that the ultraviolet curable ink is cured in a speedy manner by adhering the ultraviolet curable ink to a recording medium (print sheet) or the like and then irradiating ultraviolet rays of an appropriate amount onto the adhered ultraviolet curable ink, and thereby maintaining a stable printing quality without being influenced by physical properties of the recording medium such as ink permeability and the like.

In ink jet recording apparatuses (ink jet printers) using such ultraviolet curable ink, an ultraviolet ray irradiation device that irradiates ultraviolet rays on ink adhered on a recording medium is required to be installed in the vicinity of a record head that adheres the ultraviolet curable ink on the recording medium by ejecting the ultraviolet curable ink in minute ink droplets, and a carriage, which includes a record head and reciprocates in the width direction of the recording medium, equipped with the above-described ultraviolet ray irradiation device has been proposed (for example, see Patent Document 1).

[Patent Document 1] Japanese Unexamined Patent Application Publication No. H2004-237603

SUMMARY

However, generally, an ultraviolet ray having a long wavelength tends to have a stronger permeability for ink coating than an ultraviolet ray having a short wavelength, and energy included in one photon of the ultraviolet ray having a short wavelength tends to be higher than that of the ultraviolet ray having a long wavelength. Thus, a problem of blurring or color mixing in a portion in which a plurality of types of ultraviolet curable ink are overlapped may occur for a full-color printing (multiple color printing) process in a case where, for example, the viscosity of ink adhered to a recording medium is low and ink coating is relatively thin. This problem occurs because a curing process is sequentially performed starting from a deep portion of the ink coating on the inner side in a case where an ultraviolet ray irradiated onto the ink coating, which has low viscosity and is thin, has a long wavelength, and thereby the ink coating on the surface side is cured late.

Accordingly, in order to solve the above-described problems, the object of the present invention is to provide an ultraviolet ray irradiation device and a recording method capable of sufficiently curing a plurality of colors of ultraviolet curable color ink adhered on the recording medium for multiple color printing such as full-color printing without incurring a problem of blurring or color mixing. In addition, another object of the present invention is to provide a recording apparatus using the above-described ultraviolet ray irradiation device.

The above-described object of the present invention can be achieved by an ultraviolet ray irradiation device including an ultraviolet light source that irradiates ultraviolet rays onto a plurality of ultraviolet curable ink ejected on a recording medium by a record head, wherein an ultraviolet ray of the ultraviolet light source that irradiates the ultraviolet ray onto the recording medium in the vicinity of the record head has a wavelength shorter than an ultraviolet ray of the ultraviolet light source that irradiates the ultraviolet ray onto the recording medium apart from the vicinity of the record head.

According to the above-described ultraviolet ray irradiation device, an ultraviolet ray that has a short wavelength and is irradiated onto the recording medium in the vicinity of the record head is irradiated first onto the ink coating adhered on the recording medium by ejection from the record head, and thereby curing the surface of the ink coating with high energy. Thereafter, an ultraviolet ray that has a long wavelength and is irradiated onto the recording medium apart from the vicinity of the record head is irradiated onto the ink coating, and thereby curing a deep portion of the ink coating on the inner side.

Accordingly, for example, even in a multiple color printing process for a case where the viscosity of the ink is low and the coating of the ink coating is relatively thin, the ultraviolet ray irradiation device can sufficiently cure the plurality of ultraviolet curable ink adhered to the recording medium without incurring a problem of blurring or color mixing.

Here, the "wavelength" indicates a wavelength that is a peak of light emitted from a light source.

In addition, in the ultraviolet ray irradiation device having the above-described configuration, it is preferable that the ultraviolet ray irradiation device includes a plurality of ultraviolet light sources and the plurality of ultraviolet light sources includes a short-wavelength light source disposed in the vicinity of the record head and a long-wavelength light source disposed apart from the record head relative to the short-wavelength light source.

According to the ultraviolet ray irradiation device having the above-described configuration, an ultraviolet ray that has a short wavelength and is irradiated onto the recording medium in the vicinity of the record head is irradiated first onto the ink coating adhered onto the recording medium by ejection from the record head from the ultraviolet light source for the short wavelength disposed in the vicinity of the record head, and thereby curing the surface of the ink coating with high energy. Thereafter, an ultraviolet ray that has a long wavelength and is irradiated onto the recording medium apart from the vicinity of the record head is irradiated onto the ink coating from the ultraviolet light source for the long wave length disposed to be apart from the record head relative to the light source for the short wavelength, and thereby curing the deep portion of the ink coating on the inner side.

In addition, according to the ultraviolet ray irradiation device having the above-described configuration, the layout of the short-wavelength light source and the long-wavelength light source can be easily made, and thus the configuration of the ultraviolet light sources can be simple, and thereby it is possible to reduce the manufacturing cost.

In the ultraviolet ray irradiation device having the above-described configuration, it is preferable that the plurality of ultraviolet light sources irradiates ultraviolet rays having wavelengths, which sequentially increase as the ultraviolet light sources are positioned far apart from the vicinity of the record head, onto the recording medium.

According to the ultraviolet ray irradiation device having the above-described configuration, onto the ink coating ejected on the recording medium, ultraviolet rays having sequentially increased wavelengths starting from an ultraviolet ray having the shortest wavelength can be irradiated. Accordingly, a plurality of ultraviolet curable ink adhered on the recording medium can be sequentially cured from the surface of the ink coating to the deep portion on the inner side, which is cured last, without incurring a problem of blurring or color mixing, and thereby the entire ink coating can be cured assuredly.

In addition, it is preferable that the ultraviolet ray irradiation device having the above-described configuration further includes means for dividing the ultraviolet rays emitted from the ultraviolet light source into a plurality of ultraviolet rays having different wavelengths.

According to the ultraviolet ray irradiation device having the above-described configuration, onto the ink coating adhered on the recording medium by ejection from the record head, a short-wavelength ultraviolet ray separated by the means for dividing ultraviolet rays into a plurality of ultraviolet rays having different wavelengths is irradiated first onto the recording medium in the vicinity of the record head, and thereby curing the surface of the ink coating with high energy. Thereafter, a long-wavelength ultraviolet ray separated by the above-described means is irradiated on the recording medium apart from the vicinity of the record head, and thereby curing the deep portion of the ink coating on the inner side.

According to the means, it is possible to divide ultraviolet rays emitted from the ultraviolet light sources into a plurality of ultraviolet rays having different wavelengths without installing a plurality of ultraviolet light sources.

In the ultraviolet ray irradiation device having the above-described configuration, it is preferable that the above-described means is a filter that preferentially transmits a specific wavelength.

According to the ultraviolet ray irradiation device having the above-described configuration, the ultraviolet rays irradiated onto the recording medium from the ultraviolet light source are assuredly wavelength-divided by the filter interposed between the ultraviolet light source and the recording medium, and a state that the short-wavelength ultraviolet rays are irradiated onto the ink on the recording medium earlier than the long-wavelength ultraviolet rays can be acquired.

In addition, in the ultraviolet ray irradiation device having the above-described configuration, it is preferable that a reflection mechanism is disposed in a position facing the filter and reflects the ultraviolet rays emitted from the ultraviolet light source to the filter side.

According to the ultraviolet ray irradiation device having the above-described configuration, the ultraviolet rays emitted on the sides opposite to each filter side from the ultraviolet light source are returned to the filter side by reflection from the reflection mechanism and are used for curing the ultraviolet curable ink, and thereby the use efficiency of the ultraviolet rays emitted from the ultraviolet light sources is improved.

In addition, for example, by forming the reflection surface of the reflection mechanism as a parabolic surface having the center of light emission of the ultraviolet light source as its center, it is possible to uniform the intensity of ultraviolet rays irradiated onto the ink by adjusting the direction of the ultraviolet rays transmitting through each filter, and thereby capability for curing the ink through the ultraviolet irradiation can be stabilized.

In the ultraviolet ray irradiation device having the above-described configuration, it is preferable that the means divides the ultraviolet rays such that the wavelength for transmission sequentially increases as the means is positioned far apart from the vicinity of the record head.

According to the ultraviolet ray irradiation device having the above-described configuration, onto the ink coating ejected on the recording medium, ultraviolet rays having sequentially increased wavelengths starting from an ultraviolet ray having the shortest wavelength can be irradiated.

In addition, in the ultraviolet ray irradiation device having the above-described configuration, it is preferable that the record head is a line-type head that is provided along the width direction of the recording medium and an ultraviolet ray of the ultraviolet light source that irradiates the ultraviolet ray onto the recording medium in the vicinity of the record head has a wavelength shorter than an ultraviolet ray of the ultraviolet light source that irradiates the ultraviolet ray onto the recording medium apart from the vicinity of the record head along the transport direction of the recording medium.

According to the above-described ultraviolet ray irradiation device, an ultraviolet ray that has a short wavelength and is irradiated onto the recording medium in the vicinity of the line-type record head on the paper discharge side is irradiated first onto the ink coating adhered on the recording medium by ejection from the line-type record head, and thereby curing the surface of the ink coating with high energy. Thereafter, while the recording medium is transported, an ultraviolet ray that has a long wavelength and is irradiated onto the recording medium apart from the vicinity of the line-type record head in the transport direction of the recording medium is irradiated onto the ink coating, and thereby the deep potion of the ink coating on the inner side can be cured.

In the ultraviolet ray irradiation device having the above-described configuration, it is preferable that the recording head is a head built in a carriage and an ultraviolet ray of the ultraviolet light source that irradiates the ultraviolet ray onto the recording medium in the vicinity of the record head has a wavelength shorter than an ultraviolet ray of the ultraviolet light source that irradiates the ultraviolet ray onto the recording medium apart from the vicinity of the record head along the moving direction of the carriage.

According to the above-described ultraviolet ray irradiation device, an ultraviolet ray that has a short wavelength and is irradiated onto the recording medium in the vicinity of the record head is irradiated first onto the ink coating adhered on the recording medium by ejection from the record head, and thereby curing the surface of the ink coating with high energy. Thereafter, while the carriage is moved, an ultraviolet ray that has a long wavelength and is irradiated onto the recording medium apart from the vicinity of the record head along the moving direction of the carriage is irradiated onto the ink coating, and thereby the deep portion of the ink coating on the inner side can be cured.

In addition, in the ultraviolet ray irradiation device having the above-described configuration, it is preferable that the ultraviolet ray irradiation device is provided on both ends along the moving direction of the carriage.

According to the above-described ultraviolet ray irradiation device, the ink coating can be quickly cured regardless of the head scanning direction of the carriage by ejecting ink onto the recording medium from the record head, while reciprocating the carriage, and by irradiating the ultraviolet ray by using an ultraviolet ray irradiation device disposed on a rear side in the head scanning direction, and thereby it is possible to increase the printing speed.

In addition, in the ultraviolet ray irradiation device having the above-described configuration, it is preferable that the ultraviolet light source is at least one selected from among an LED, an LD, a mercury lamp, a metal halide lamp, a xenon lamp, and an Excimer lamp.

Especially when the ultraviolet ray irradiation device is configured to have a plurality of ultraviolet light sources, each of the short-wavelength and long-wavelength ultraviolet light sources can be prepared by using one between an LED and an LD as the ultraviolet light source without using a filter or the like. Thus, when compared to a case, for example, where a mercury lamp, a metal halide lamp, or a lamp of another type is used as the ultraviolet light source, it is possible to prevent an increase in size of the ultraviolet ray irradiation device due to an equipment such as a filter, and it is possible to effectively perform a curing process for ultraviolet curable ink without decreasing the intensity of the emitted ultraviolet rays due to absorption by a filter.

On the other hand, when a configuration in which ultraviolet rays emitted from an ultraviolet light source are divided into a plurality of ultraviolet rays having different wavelengths by the filter is used, the wavelength of the ultraviolet rays can be adjusted, and accordingly, the degree of freedom of ultraviolet light source selection is high. Thus, for example, in a case where the wavelength regions of ultraviolet rays absorbed by coloring materials (pigments or dyes) contained in ultraviolet ray curable color ink, curing temperature, or the like are different, it is possible to perform a curing process more effectively using irradiation of ultraviolet rays by selecting an ultraviolet light source having a wavelength region and heat generating temperature which are appropriate to the physical properties of the ink.

In addition, the above-described object of the present invention is achieved by a recording apparatus including the above-described ultraviolet ray irradiation device.

According to the above-described ultraviolet ray irradiation device, for example, in a multiple color printing process for a case where the viscosity of ink is low and the ink coating is relatively thin, a recording process can be performed well using a plurality of ultraviolet curable ink adhered on the recording medium without incurring a problem of blurring or color mixing.

In addition, the above-described object of the present invention is achieved by a method of recoding on a recording medium in multiple colors by using a plurality of ultraviolet curable ink, wherein, when the plurality of ultraviolet curable ink ejected on the recording medium from a record head is to be cured, the ultraviolet ray curable ink is cured by irradiating an ultraviolet ray of the ultraviolet light source that irradiates the ultraviolet ray on the recording medium in the vicinity of the record head which has a wavelength shorter than an ultraviolet ray of the ultraviolet light source that irradiates the ultraviolet ray onto the recording medium apart from the vicinity of the record head.

According to the above-described method of recording, for example, in a multiple color printing process for a case where the viscosity of ink is low and the ink coating is relatively thin, a recording process can be performed well by using a plurality of ultraviolet curable ink adhered on the recording medium without incurring a problem of blurring or color mixing.

DESCRIPTION OF REFERENCE NUMERALS AND SIGNS

20: INK JET PRINTER (INK JET RECORDING APPARATUS)
30: PAPER FEED MOTOR
40: PLATEN
50: CARRIAGE
52: PRINT HEAD (RECORD HEAD)
54: BLACK CARTRIDGE
56: COLOR INK CARTRIDGE
60: CARRIAGE MOTOR
62: TRACTION BELT
64: GUIDE RAIL
80: CAPPING MECHANISM
90A (190A, 290A), 90B (190B, 290B): ULTRAVIOLET RAY IRRADIATION DEVICE
192, 193, 291: ULTRAVIOLET LIGHT SOURCE
194, 293: CASE
196, 296: INK COATING (INK)
P: PRINT SHEET (RECORDING MEDIUM)
294: REFLECTION MECHANISM
F1: FILTER
F2: FILTER

DESCRIPTION OF EXEMPLARY EMBODIMENTS

Hereinafter, an ultraviolet ray irradiation device and a recording apparatus using the ultraviolet ray irradiation device, and a method of irradiating an ultraviolet ray according to embodiments of the present invention will be described with reference to the accompanying drawings.

Figure 1:
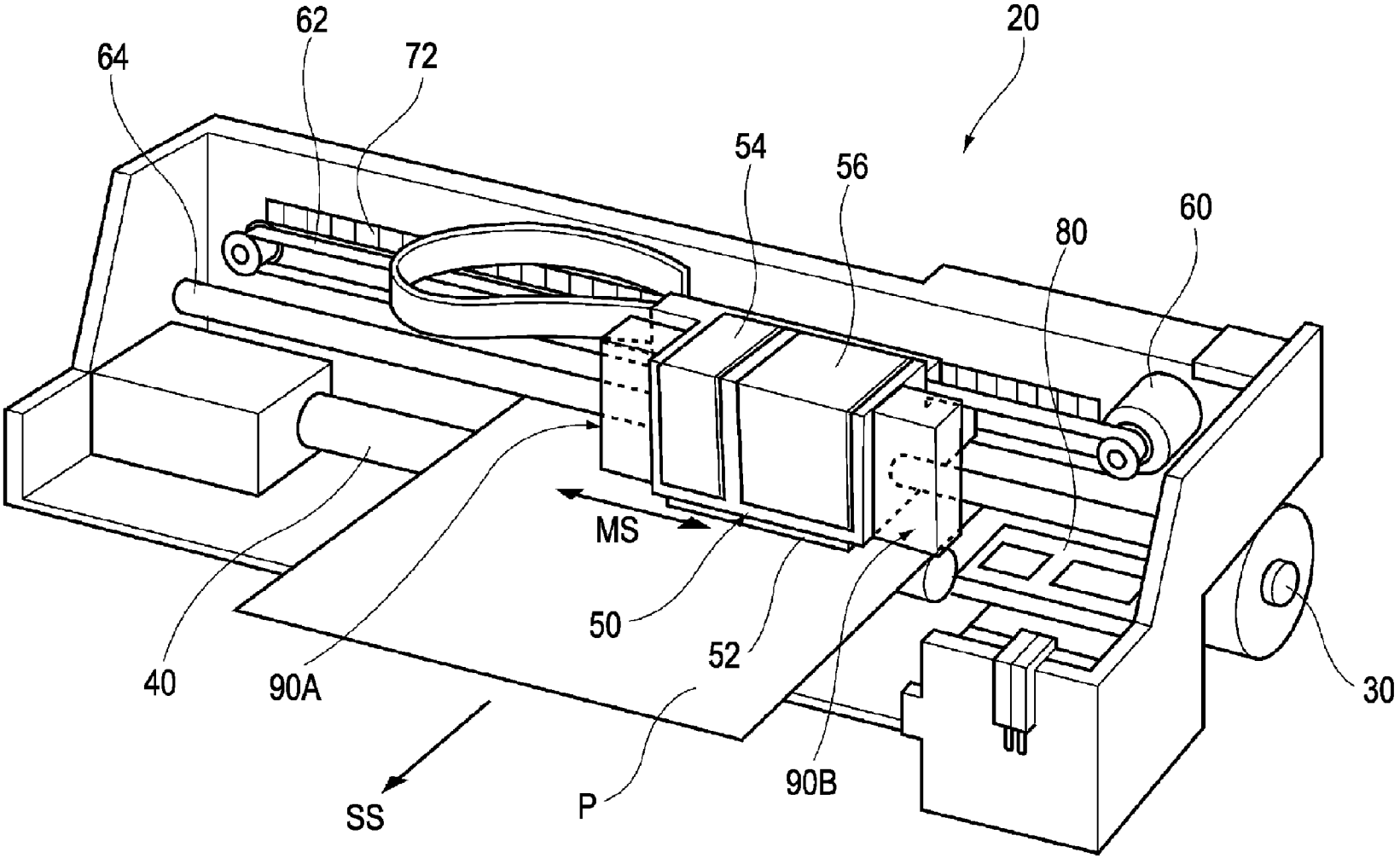
FIG. 1 is a perspective view of an ink jet recoding apparatus having an ultraviolet ray irradiation device according to a first embodiment and a third embodiment of the present invention.

FIG. 1 is a perspective view of an ink jet recoding apparatus having an ultraviolet ray irradiation device according to a first embodiment of the present invention.

The ink jet printer (ink jet recording apparatus) 20 shown in FIG. 1 includes a paper transport motor 30 transporting a print sheet P that is a recording medium in a sub scanning direction SS, a platen 40, a print head 52 as a recording head that ejects ultraviolet curable ink as particles having minute diameters from a head nozzle and adheres the ultraviolet curable ink to the print sheet P, a carriage 50 in which the print head 52 is built, a carriage motor 60 that moves the carriage 50 in a main scanning direction MS, and a pair of ultraviolet ray irradiation devices 90A and 90B that emit ultraviolet rays onto an ink-adhered surface on the print sheet P on which the ultraviolet curable ink is attached by the print head 52.

The carriage 50 is pulled by a traction belt 62 driven by the carriage motor 60 and is moved along a guide rail 64.

The print head 52 shown in FIG. 1 is so-called a serial head for printing full colors which ejects ink of three colors or more, and a plurality of head nozzles is included for each color. In the carriage 50 in which the print head 52 is built, a black cartridge 54 as a black ink container containing black ink to be supplied to the print head 52 and a color ink cartridge 56 as a color ink container containing color ink to be supplied to the print head 52 are included in addition to the print head 52.

The ink contained in the cartridges 54 and 56 is so-called ultraviolet curable ink.

In a home position (a right side position in FIG. 1) of the carriage 50, a capping mechanism 80 for sealing the nozzle face of the print head 52 in a case where the carriage is stopped is provided. When a print job is completed and the carriage 50 reaches a position above this capping mechanism 80, the capping mechanism 80 is automatically lifted by a mechanism not shown in the figure and seals the nozzle face of the print head 52. By this capping operation, dryness of ink inside the nozzles is prevented. A control process for determining the position of the carriage 50 is performed, for example, for precisely positioning the carriage 50 to the position of this capping mechanism 80.

Figure 2:
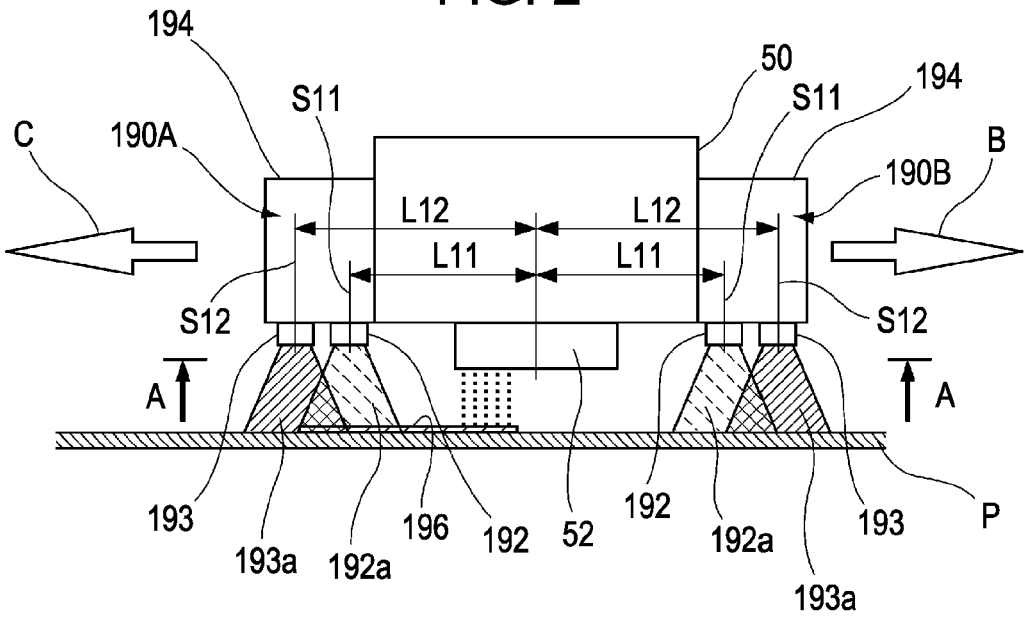
FIG. 2 is a front view of the ultraviolet ray irradiation device according to the first embodiment shown in FIG. 1.
Figure 3:
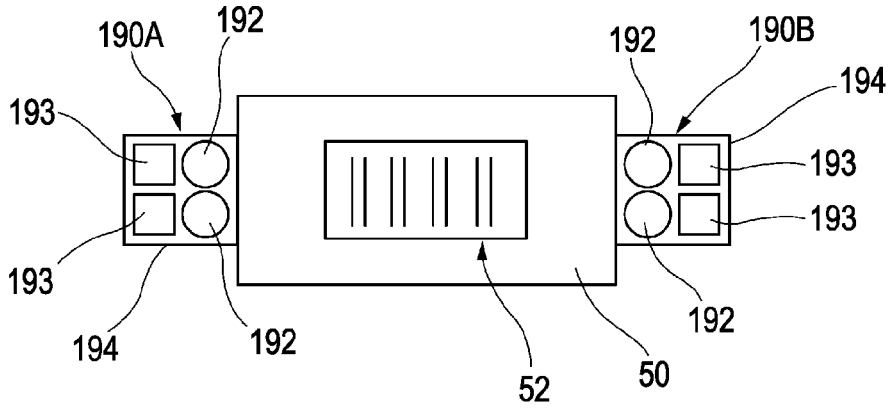
FIG. 3 is a diagram viewed from arrow A-A of FIG. 2.

FIG. 2 is a front view of the ultraviolet ray irradiation devices 90A (corresponding to 190A of FIG. 2) and 90B (corresponding to 190B of FIG. 2) which are shown in FIG. 1, and FIG. 3 is a diagram viewed from arrow A-A of FIG. 2.

The ultraviolet ray irradiation devices 190A and 190B, as shown in FIGS. 1 to 3, are attached to both ends on sides along the moving direction of the carriage 50.

As shown in FIG. 2, the ultraviolet ray irradiation device 190A that is attached on the left side toward the print head 52 irradiates an ultraviolet ray on ink coating 196 ejected onto the print sheet P at a time for a right scanning process in which the carriage 50 moves in the right direction (direction of arrow B shown in FIG. 2). On the other hand, the ultraviolet ray irradiation device 190B that is attached on the right side toward the print head 52 irradiates an ultraviolet ray on the ink coating 196 ejected on the print sheet P at a time for a left scanning process in which the carriage 50 moves in the left direction (direction of arrow C shown in FIG. 2).

Each of the ultraviolet ray irradiation devices 190A and 190B includes a case 194 that is attached to the carriage 50 and arranges/supports a plurality of ultraviolet light sources 192 and 193 of two types having different wavelengths of emitting ultraviolet rays and a light source control circuit, not shown in the figure, that controls lighting and extinguishing each of the ultraviolet light sources 192 and 193.

The ultraviolet light source 192 installed to each of the ultraviolet ray irradiation devices 190A and 190B is a light source for a short wavelength which irradiates an ultraviolet ray having a short wavelength of about 360 nm, and the ultraviolet light source 193 is a light source for a long wavelength which irradiates an ultraviolet ray having a wavelength of about 390 nm which is longer than that of the ultraviolet light source 192.

According to the first embodiment, in each of the ultraviolet ray irradiation devices 190A and 190B, two ultraviolet light sources 192 and two ultraviolet light sources 193 of the two types are disposed.

In addition, a plurality of ultraviolet light sources 192 and 193 as these two types of ultraviolet light sources 192 and 193, as shown in FIGS. 2 and 3, is installed to a plurality of attachment positions S11 and S12 having gap distance L11 and L12 (where L11<L12) from the print head 52 along the moving direction (the direction of arrow B or C shown in FIG. 2) of the carriage 50 such that the ultraviolet light source 192 from which an ultraviolet ray having a short wavelength is emitted is disposed closer to the print head 52 than the ultraviolet light source 193 having a long wavelength.

In addition, the light source control circuit, not shown in the figure, that controls lighting and extinguishing each of the ultraviolet light sources 192 and 193 controls a light emitting timing of each of the ultraviolet light sources 192 and 193 such that the short-wavelength ultraviolet ray emitted from the ultraviolet light source 192 is irradiated onto the ink coating 196 adhered on the print sheet P before the long-wavelength ultraviolet ray emitted from the ultraviolet light source 193.

According to the first embodiment, one between an LED and an LD is used as each of the ultraviolet light sources 192 and 193. Accordingly, each of the short-wavelength and long-wavelength ultraviolet light sources can be prepared only by a light source without using a filter or the like. Thus, when compared to a case, for example, where a mercury lamp, a metal halide lamp, or a lamp of another type is used as the ultraviolet light source, it is possible to prevent an increase in size of the ultraviolet ray irradiation device due to an equipment such as a filter and it is possible to effectively perform a curing process for ultraviolet curable ink without decreasing the intensity of the emitted ultraviolet rays due to absorption by a filter.

Since selection of the ultraviolet light source to be included in the case 194 is performed in consideration of an allowable size of the ultraviolet light source to be included in the case 194, an allowable temperature in the vicinity of the print head 52, or the like, the ultraviolet light source is not limited to an LED or an LD, and thus an appropriately selected ultraviolet light source from among a mercury lamp, a metal halide lamp, a xenon lamp, and an Excimer lamp can be used.

In other words, in a case where the wavelength regions of ultraviolet rays absorbed by coloring materials (pigments or dyes) for coloring which are included in ultraviolet ray curable color ink, curing temperature, or the like are different, it is possible to perform a curing process more effectively using irradiation of ultraviolet rays by selecting an ultraviolet light source having a wavelength region and heat generating temperature which are appropriate to the physical properties of the ink.

According to the above-described ultraviolet ray irradiation devices 190A and 190B, as shown in FIG. 2, an ultraviolet ray 192*a* having a short wavelength is irradiated first onto the ink coating 196 adhered on the print sheet P, which is a recording medium, by ejection from the print head 52 by the ultraviolet light source 192 which irradiates the ultraviolet ray onto the print sheet P in the vicinity of the print head 52, and thereby curing the surface of the ink coating 196 with high energy. Thereafter, while the carriage 50 is moved, an ultraviolet ray 193*a* having a long wavelength is irradiated onto the ink coating 196 by the ultraviolet light source 193 that irradiates the ultraviolet light onto the print sheet P apart from the vicinity of the print head 52 in the moving direction of the carriage 50, and thereby curing the deep portion of the ink coating 196 on the inner side.

Accordingly, even in a printing process for a case where the viscosity of the ink is low and the coating of the ink coating 196 is relatively thin as in this embodiment, the ultraviolet ray irradiation devices 190A and 190B can sufficiently cure the plurality of ultraviolet curable ink adhered on the print sheet P without incurring a problem of blurring or color mixing.

The configuration of the ultraviolet ray irradiation device according to the present invention is not limited to the configuration according to the above-described embodiment which has the recording head, the carriage, the ultraviolet light source, and the like, and it is needless to say that the configuration may be changed in various forms based on the purpose of the present invention.

For example, in the above-described embodiment, although two ultraviolet light sources 192 and 193 are provided as ultraviolet light sources having different wavelengths of emitting ultraviolet rays, three or more ultraviolet light sources having different wavelengths of emitting ultraviolet rays may be used. In such a case, the ultraviolet light sources are disposed such that the wavelength of the ultraviolet ray emitted from an ultraviolet light source become longer as the gap distance of the ultraviolet light source from the print head 52 increases.

In addition, in the above-described embodiment, although an ultraviolet ray of the ultraviolet light source irradiating the ultraviolet ray onto the print sheet P in the vicinity of the print head 52 is configured to have a wavelength shorter than an ultraviolet ray of the ultraviolet light source irradiating the ultraviolet ray on the print sheet P apart from the vicinity of the print head 52 along the moving direction of the carriage 50 by disposing the ultraviolet light source 192 emitting a short-wavelength ultraviolet ray 192*a* in a position closer to the print head 52 than that of the ultraviolet ray source 193 emitting a long-wavelength ultraviolet 193*a*, it is also possible to dispose the ultraviolet light source 192 and the ultraviolet light source 193 in same distance from the print head 52 or to dispose the ultraviolet light source 193 in a position closer to the print head 52 than the ultraviolet light source 192. In other words, attachment positions of the ultraviolet light source 192 and the ultraviolet light source 193 can be appropriately changed if irradiation directions of the ultraviolet light sources 192 and 193 are respectively set such that the ultraviolet ray 192*a* of the ultraviolet light source 192 is irradiated on the print sheet P in the vicinity of the print head 52 and the ultraviolet ray 193*a* of the ultraviolet light source 193 is irradiated on the print sheet P apart from the print head 52.

In addition, in the above-described embodiment, although a so-called serial head is used as the print head 52 that ejects the ultraviolet curable ink on the recording medium, a recording head of the present invention is not limited thereto.

Next, an ink jet recording apparatus equipped with an ultraviolet ray irradiation device according to a second embodiment of the present invention will be described.

Figure 4:
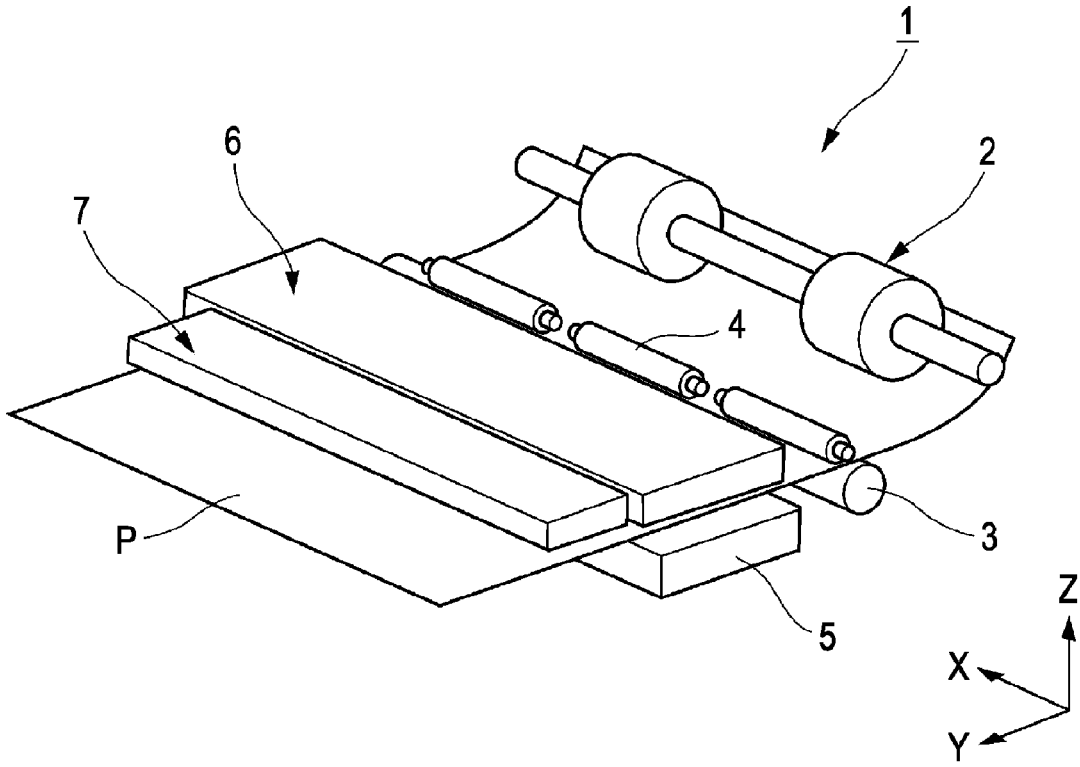
FIG. 4 is a perspective view of an ink jet recoding apparatus having an ultraviolet ray irradiation device according to a second embodiment and a fourth embodiment of the present invention.

An ink jet printer (ink jet recording apparatus) 1 according to the second embodiment of the present invention shown in FIG. 4 includes a paper feed roller 2 for feeding a print sheet P that is a recording medium from a paper tray not shown in the figure, a transport roller 3 for transporting the print sheet P, a driven roller 4 disposed to face the transport roller 3, a platen 5 for supporting the print sheet P, a print head 6 as a recording head which is disposed to face the platen 5, and an ultraviolet ray irradiation device 7 that irradiates an ultraviolet ray onto an ink-adhered surface on the print sheet P to which the ultraviolet curable ink is adhered by the print head 6.

Figure 5:
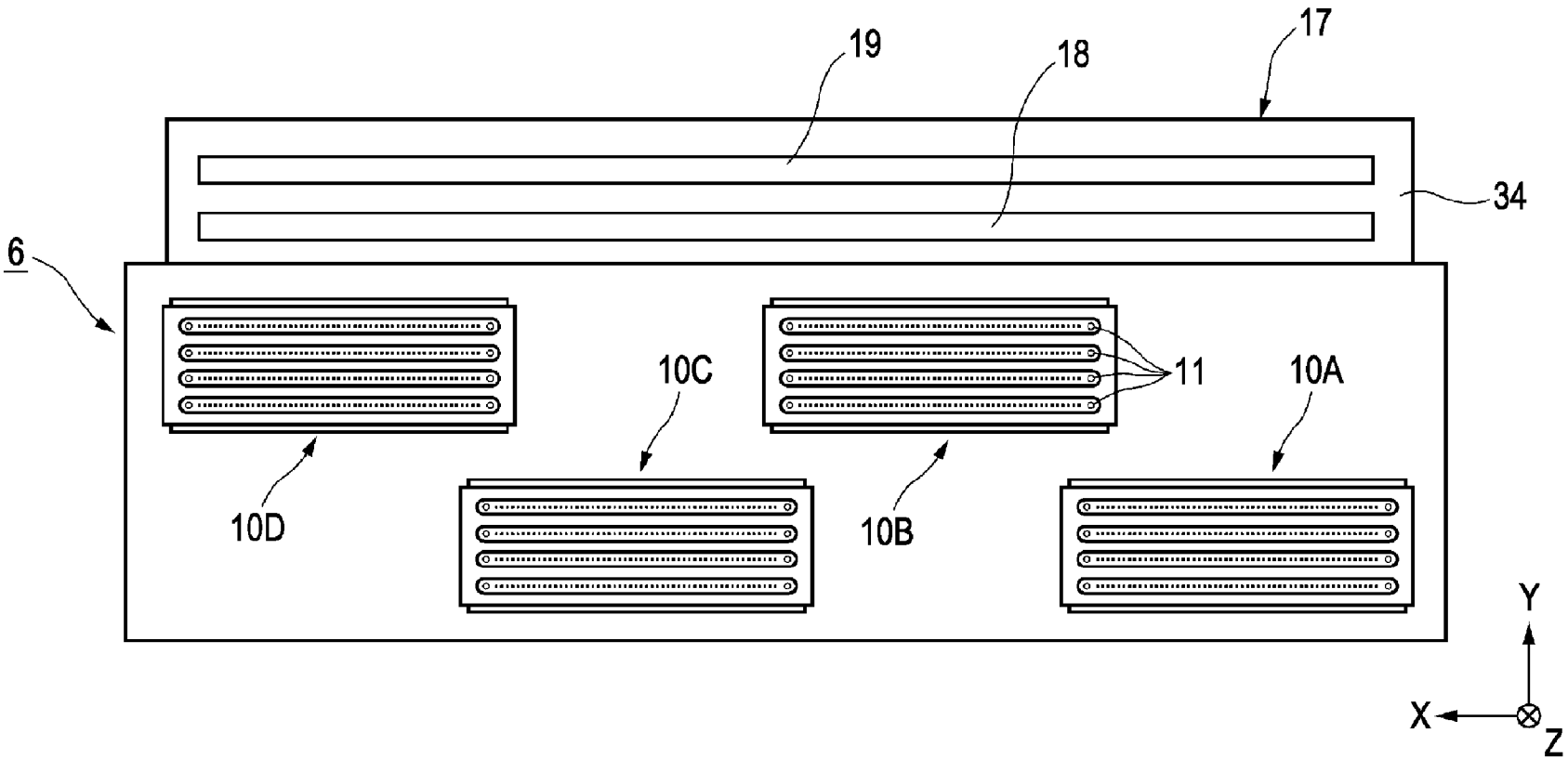
FIG. 5 is a plan view of an ultraviolet ray irradiation device and a record head, shown in FIG. 4, according to a second embodiment of the present invention.

As shown in FIG. 5, the print head 6 is a line-type head including a plurality head modules 10A to 10D on a side corresponding to the platen 5. Each of the head modules 10A to 10D has nozzles 11 formed so as to form a four-line array along a paper width direction (direction of axis X), a liquid chamber that communicates with the individual nozzles 11, and a piezoelectric element (not shown in the figure).

The head modules 10A to 10D are configured to perform a full color printing process by ejecting four-color ink of black, cyan, magenta, and yellow supplied from ink supply means not shown in the figure from the nozzles 11 of each line array.

In FIG. 5, the ultraviolet light source 18 installed to the ultraviolet ray irradiation device 17 (corresponding to the ultraviolet ray irradiation device 7 shown in FIG. 4) is a light source for a short wavelength which irradiates an ultraviolet ray having a short wavelength of about 360 nm, and the ultraviolet light source 19 is a light source for a long wavelength which irradiates an ultraviolet ray having a wavelength of about 390 nm which is longer than that of the ultraviolet light source 18.

Figure 6:
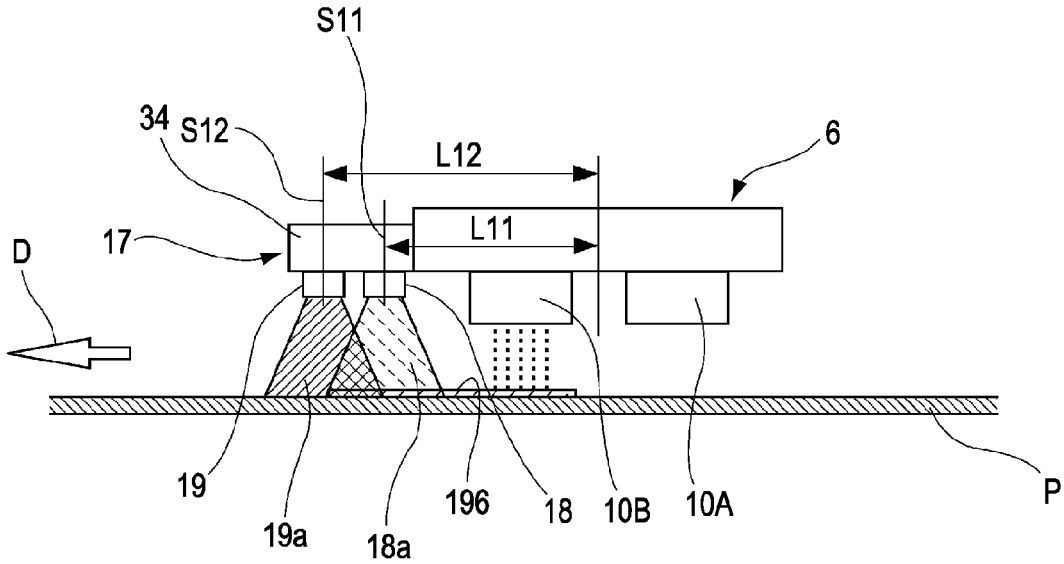
FIG. 6 is a front view of an ultraviolet ray irradiation device, which is the ultraviolet ray irradiation device shown in FIG. 5, according to the second embodiment of the present invention.

Two ultraviolet light sources 18 and 19 as these two types of ultraviolet light sources 18 and 19, as shown in FIGS. 5 and 6, are installed to a plurality of attachment positions S11 and S12 having gap distance L11 and L12 (where L11<L12) from the center of the print head 6 along the transport direction (the direction of arrow D shown in FIG. 6) of the print sheet P such that the ultraviolet light source 18 from which an ultraviolet ray having a short wavelength is emitted is disposed closer to the print head 6 than the ultraviolet light source 19 having a long wavelength.

In addition, the light source control circuit, not shown in the figure, that controls lighting and extinguishing each of the ultraviolet light sources 18 and 19 controls a light emitting timing of each of the ultraviolet light sources 18 and 19 such that the short-wavelength ultraviolet ray emitted from the ultraviolet light source 18 is irradiated on the ink coating 196 adhered on the print sheet P before the long-wavelength ultraviolet ray emitted from the ultraviolet light source 19.

According to this embodiment, as each of the ultraviolet light sources 18 and 19, a mercury lamp, a metal halide lamp, or a lamp of another type which is long in the paper width direction is used, and the ultraviolet light sources cure the ink coating 196 adhered to the print sheet P uniformly along the paper width direction.

Since selection of the ultraviolet light source to be included in the case 34 is performed in consideration of an allowable size of the ultraviolet light source to be included in the case 34, an allowable temperature in the vicinity of the print head 6, or the like, the ultraviolet light source is not limited to a mercury lamp, a metal halide lamp, or a lamp of another type, and thus an ultraviolet light source such as an LED, an LD, or the like can be used.

In other words, in a case where the wavelength regions of ultraviolet rays absorbed by coloring materials (pigments or dyes) for coloring which are included in ultraviolet ray curable color ink, curing temperature, or the like are different, it is possible to perform a curing process more effectively using irradiation of ultraviolet rays by selecting an ultraviolet light source having a wavelength region and heat generating temperature which are appropriate to the physical properties of the ink.

According to the above-described ultraviolet ray irradiation device 17, as shown in FIG. 6, an ultraviolet ray 18*a* having a short wavelength is irradiated first onto the ink coating 196 ejected onto the print sheet P, which is a recording medium, by ejection from the plurality of head modules 10A to 10D of the print head 6 by the ultraviolet light source 18 which irradiates an ultraviolet ray onto the print sheet P in the vicinity of the print head 6, and thereby curing the surface of the ink coating 196 with high energy. Thereafter, while the print sheet P is transported, an ultraviolet ray 19*a* having a long wavelength is irradiated onto the ink coating 196 by the ultraviolet light source 19 which irradiates an ultraviolet ray onto the print sheet P apart from the vicinity of the print head 6 in the transport direction (Y-axis direction) of the print sheet P, and thereby curing the deep portion of the ink coating 196 on the inner side.

Accordingly, even in a printing process for a case where the viscosity of the ink is low and the ink coating is relatively thin as in this embodiment, the ultraviolet ray irradiation device 17 can sufficiently cure the plurality of ultraviolet curable ink adhered to the print sheet P without incurring a problem of blurring or color mixing.

Next, an ink jet recording apparatus equipped with an ultraviolet ray irradiation device according to a third embodiment of the present invention will be described.

Figure 7:
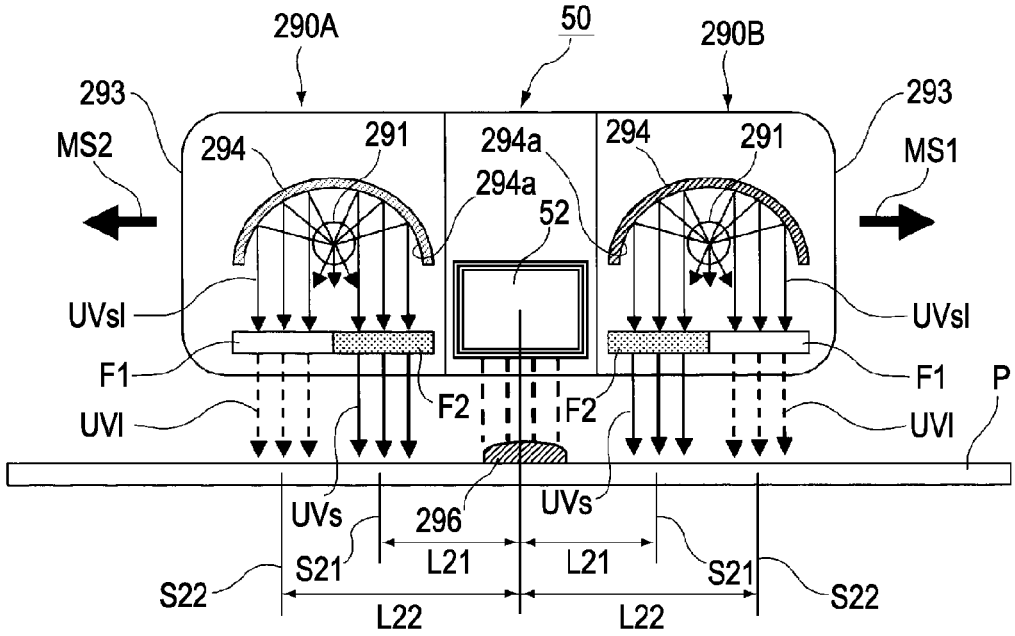
FIG. 7 is a schematic cross-sectional view of an ultraviolet ray irradiation device and a record head, which are the ultraviolet ray irradiation device and the record head shown in FIG. 1, according to a third embodiment of the present invention.

The third embodiment is the same as the above-described first embodiment except that ultraviolet ray irradiation devices 290A and 290B shown in FIG. 7 are included as the ultraviolet ray irradiation devices 90A and 90B in FIG. 1.

Each of the ultraviolet ray irradiation devices 290A and 290B, as shown in FIG. 7, has a configuration in which an ultraviolet light source 291 having a broad wavelength band of emitting ultraviolet rays, a case 293 that is attached to a carriage 50 and supports the above-described ultraviolet light source 291 to have a predetermined gap distance from a print head 52, two filters F1 and F2 that divide ultraviolet rays UVsl having a broad wavelength band emitted from the ultraviolet light source 291 into long-wavelength ultraviolet rays UVl and short-wavelength ultraviolet rays UVs, reflection mechanisms 294 that reflect the ultraviolet rays UVsl having a broad wavelength band emitted from the ultraviolet light source 291 toward the two filters F1 and F2, and a light source control circuit, not shown in the figure, that controls lighting and extinguishing of the ultraviolet light source 291 are included.

As the ultraviolet light source 291, it is preferable that at least one selected from among a mercury lamp, a metal halide lamp, a xenon lamp, an Excimer lamp, and the like which have a broad wavelength band of emitting ultraviolet rays is used.

Between two filters F1 and F2 that are filters preferentially transmitting predetermined wavelengths, one filter F1 is a long wavelength filter that transmits a long wavelength ultraviolet having a wavelength of about 390 nm when receiving irradiation of ultraviolet rays UVsl having a broad wavelength band. In addition, the other filter F2 is a short wavelength filter that transmits a short wavelength ultraviolet ray having a wavelength equal to or smaller than 300 nm when receiving irradiation of ultraviolet rays UVsl having a broad wavelength band.

In this embodiment, although both two filers F1 and F2 as means for dividing ultraviolet rays into a plurality of ultraviolet rays having different wavelengths are disposed between the ultraviolet light source 291 and the print sheet P, the filter F2 is disposed in the vicinity of the print head 52 and the filter F1 is disposed on a side apart from the vicinity of the print head 52 along the moving direction of the carriage 50. In other words, two filters F1 and F2 are installed to a plurality of attachment positions S21 and S22 having gap distance L21 and L22 (where L21<L22) from the center of the print head 6 along the scanning direction (the direction of arrow MS1 or MS2 shown in FIG. 7) of the carriage 50 such that, between the filters F1 and F2, the short wavelength filter F2 is disposed in a position closer to the print head 6 than the long wavelength filter F1 as shown in FIG. 7.

Accordingly, the ultraviolet rays UVsl having the broad wavelength band which are irradiated on the print sheet P from the ultraviolet light source 291 are assuredly wavelength-divided by each filter F1 or F2 interposed between the ultraviolet light source 291 and the print sheet P, and a state that the long wavelength ultraviolet rays UVl are irradiated onto the ink disposed on the print sheet P earlier than the short wavelength ultraviolet rays UVs can be acquired.

The reflection mechanism 294 is disposed in a position to face the filters F1 and F2 and reflects ultraviolet rays emitted from the ultraviolet light source 291 to each filter F1 or F2 side.

The reflection surface 294*a* of this reflection mechanism 294, for example, is formed as a parabolic surface having the center of light emission of the ultraviolet light source 291 as its focus and reflects ultraviolet rays incident from the ultraviolet light source 291 in parallel with an axis line of the parabolic surface to be incident to each filter F1 or F2.

Under the above-described configuration, on a near region on the print sheet P which has a gap distance smaller than a predetermined value from the print head 52, a long-wavelength ultraviolet rays UVl separated by the filter F1 can be irradiated, and on a far region which has a gap distance equal to or larger than a predetermined value from the print head 52, a short-wavelength ultraviolet rays UVs separated by the filter F2 can be irradiated.

In the ultraviolet ray irradiation devices 290A and 290B according to this embodiment, for the ink coating 296 ejected onto the print sheet P by ejection from the print head 52, a short-wavelength ultraviolet ray UVs separated by the filter F2 is irradiated first onto the print sheet P in the vicinity of the print head 52, and thereby curing the surface of the ink coating 296 with high energy. Thereafter, while the carriage 50 is moved, a long-wavelength ultraviolet ray UVl separated by the filter F1 is irradiated on the print sheet P apart from the vicinity of the print head 52, and thereby curing the deep portion of the ink coating 296 on the inner side.

Accordingly, even in a full-color printing process for a case where the viscosity of the ink is low and the ink coating is relatively thin, the ultraviolet ray irradiation devices 290A and 290B can cure the plurality of ultraviolet curable ink adhered on the print sheet P sufficiently without incurring a problem of blurring or color mixing.

In addition, in the ultraviolet ray irradiation devices 290A and 290B according to the above-described embodiment, the reflection mechanisms 294 are disposed in positions to face the filters F1 and F2 through the ultraviolet light sources 291, and reflect ultraviolet rays emitted on sides opposite to the filter F1 or F2 sides from the ultraviolet light sources 291 to the filter F1 or F2 sides by using the reflection surfaces 294*a* of the reflection mechanisms 294.

Accordingly, the ultraviolet rays emitted on the sides opposite the filter F1 and F2 sides from the ultraviolet light sources 291 are returned to the filter F1 and F2 sides by reflection from the reflection mechanisms 294 and are used for curing the ultraviolet curable ink, and thereby the use efficiency of the ultraviolet rays emitted from the ultraviolet light sources 291 is improved.

In addition, as in this embodiment, by forming the reflection surface 294*a* of the reflection mechanism 294 as a parabolic surface having the center of light emission of the ultraviolet light source 291 as its center, it is possible to uniform the intensity of ultraviolet rays irradiated onto ink by adjusting the direction of the ultraviolet rays transmitting through the filters F1 and F2, and thereby capability for curing the ink through the ultraviolet irradiation can be stabilized.

In addition, in the ultraviolet ray irradiation devices 290A and 290B according to the above-described embodiment, since the ultraviolet light source 291 may be at least one selected from among a mercury lamp, a metal halide lamp, a xenon lamp, and an Excimer lamp and the degree of freedom of ultraviolet light source 291 selection is high, for example, in a case where the wavelength regions of ultraviolet rays absorbed by coloring materials (pigments or dyes) for coloring which are included in ultraviolet ray curable color ink, curing temperature, or the like are different, it is possible to perform a curing process more effectively using irradiation of ultraviolet rays by selecting an ultraviolet light source 291 having a wavelength region and heat generating temperature which are appropriate to the physical properties of the ink.

In addition, even in a case where any ultraviolet light source 291 is used, by dividing the ultraviolet rays UVsl having a broad wavelength band which are emitted from the ultraviolet light source 291 into long-wavelength ultraviolet rays UVl and short-wavelength ultraviolet rays UVs by using the filters F1 and F2 and irradiating the short-wavelength ultraviolet rays UVs on the ink first, as described above, the ink can be cured sufficiently without incurring a problem of blurring or color mixing.

The configuration of the ultraviolet ray irradiation device according to the present invention is not limited to the configuration according to the above-described embodiment which has the recording head, the carriage, the ultraviolet light source, and the like, and it is needless to say that the configuration may be changed in various forms based on the purpose of the present invention.

For example, in the above-described embodiment, although the ultraviolet rays emitted from the ultraviolet light source 291 is divided into two types of long and short ultraviolet rays by using two types of filters F1 and F2 as the long-wavelength filter and the short wavelength filter, depending on the properties of the ultraviolet ray curable ink, the ultraviolet rays may be divided into specific-wavelength ultraviolet rays of three types or more having different wavelengths by using filters of three types or more, and the ultraviolet rays may be sequentially irradiated onto the ink on the print sheet P in the ascending order of the wavelengths thereof.

In the above-described embodiment, although a serial head is used as the print head 52 that ejects the ultraviolet curable ink on a recording medium, a recording head according to the present invention is not limited thereto.

Hereinafter, an ink jet printer (ink jet recording apparatus) according to a fourth embodiment of the present invention will be described.

Figure 8:
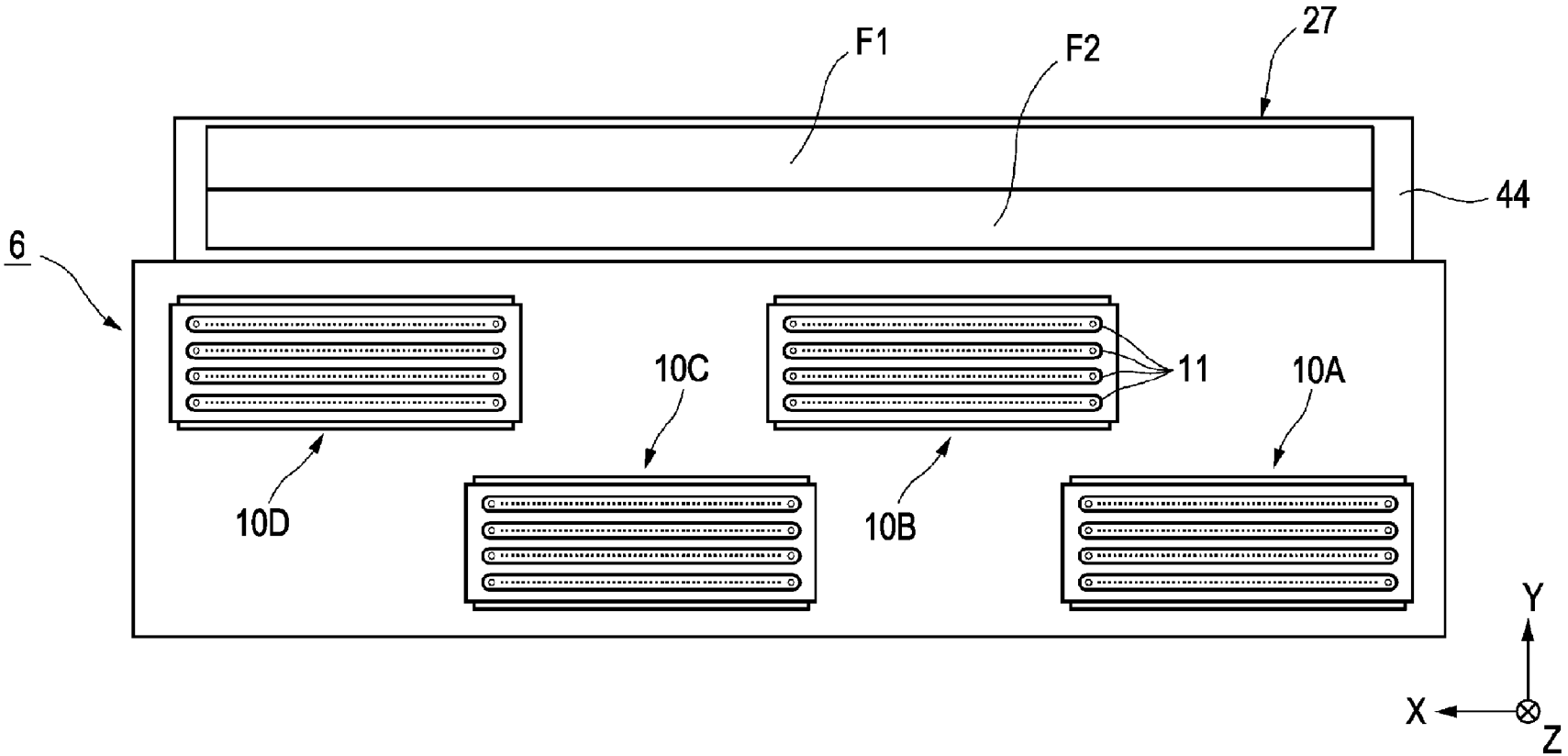
FIG. 8 is a schematic cross-sectional view of an ultraviolet ray irradiation device and a record head, which are the ultraviolet ray irradiation device and the record head shown in FIG. 4, according to a fourth embodiment of the present invention.

The fourth embodiment is the same as the above-described second embodiment except that an ultraviolet ray irradiation device 27 shown in FIG. 8 is used as the ultraviolet ray irradiation device 7 in the above-described FIG. 4.

Figure 9:
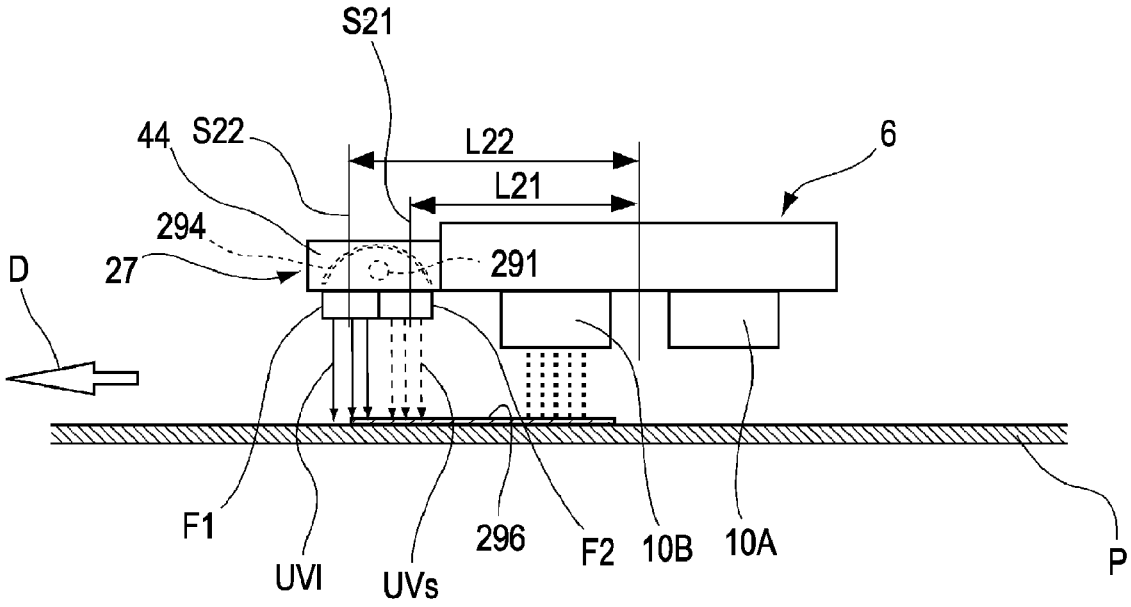
FIG. 9 is a front view of an ultraviolet ray irradiation device, which is the ultraviolet ray irradiation device shown in FIG. 4, according to the fourth embodiment of the present invention.

In this embodiment, an ultraviolet ray irradiation device 27 (corresponding to the ultraviolet ray irradiation device 7 shown in FIG. 4), as shown in FIGS. 7 to 9, is attached so as to be positioned on the paper discharge side relative to the print head 6. Although the ultraviolet ray irradiation device 27 according to this embodiment has an approximately same configuration as the above-described ultraviolet ray irradiation devices 290A and 290B according to the third embodiment, the ultraviolet ray irradiation device 27 is configured to be long in the paper width direction, and thereby the ink coating 296 adhered to the print sheet P can be uniformly cured along the paper width direction.

In other words, the ultraviolet ray irradiation device 27 has a configuration in which an ultraviolet light source 291 having a broad wavelength band of emitting ultraviolet rays, a case 44 that is attached to a print head 6 and supports the ultraviolet light source 291, which is long in the paper width direction, to have a predetermined gap distance from the print head 6, two filters F1 and F2 that divide ultraviolet rays UVsl having a broad wavelength band emitted from the ultraviolet light source 291 into long-wavelength ultraviolet rays UVl and short-wavelength ultraviolet rays UVs, reflection mechanisms 294 that reflect the ultraviolet rays UVsl having a broad wavelength band emitted from the ultraviolet light source 291 toward the two filters F1 and F2, and a light source control circuit, not shown in the figure, that controls lighting and extinguishing of the ultraviolet light source 291 are included.

These filters F1 and F2 serve as means for dividing the ultraviolet rays into a plurality of ultraviolet rays having different wavelengths, and the two filters F1 and F2 are installed to a plurality of attachment positions S21 and S22 having gap distance L21 and L22 (where L21<L22) from the center of the print head 6 along the transport direction (the direction of arrow D shown in FIG. 9) of the print sheet P such that the filter F2, which is a short-wavelength filter, is disposed in a position closer to the print head 6 than the filer F1, which is the long-wavelength filter, as shown in FIG. 9.

In the ultraviolet ray irradiation devices 27 according to this embodiment described above, as shown in FIG. 9, for the ink coating 296 adhered to the print sheet P, which is a recording medium, by ejection from a plurality of head modules 10A to 10D of the print head 6, the short-wavelength ultraviolet rays UVs separated by the filter F2 are irradiated first onto the print sheet P in the vicinity of the print head 6, and thereby the surface of the ink coating 296 is cured with high energy. Thereafter, while transporting the print sheet P, the long-wavelength ultraviolet rays UVl separated by the filter F1 are irradiated onto the print sheet P apart from the vicinity of the print head 6, and thereby curing the deep portion of the ink coating 296 on the inner side.

Accordingly, even in a full-color printing process for a case where the viscosity of the ink is low and the ink coating is relatively thin as in this embodiment, the ultraviolet ray irradiation device 27 can sufficiently cure the plurality of ultraviolet curable ink adhered on the print sheet P without incurring a problem of blurring or color mixing.

An apparatus equipped with an ultraviolet ray irradiation device according to the present invention is not limited to the ink jet printer shown in the above-described embodiments. The ultraviolet ray irradiation device can be built in various apparatuses that perform coating ultraviolet curable ink. In addition, as the material of a recording medium onto which ultraviolet rays are irradiated by the ultraviolet ray irradiation device according to the present invention, various materials such as a paper sheet, a film, a texture, a metal thin film, or the like can be considered.

EXAMPLES

Hereinafter, detailed examples of the present invention will be described. However, the present invention is not limited to the detailed examples.

The following various compositions of ultraviolet curable ink were adjusted (numbers shown in FIG. 1 represent weight %).

TABLE 1

| | Ink Composition | | | |
|---|---|---|---|---|
| | Black Ink | Cyan Ink | Magenta Ink | Yellow Ink |
| Allyl Glycol | 76.6 | 76.6 | 76.6 | 76.6 |
| U-15HA | 15 | 15 | 15 | 15 |
| Irgacure 819 | 4 | 4 | 4 | 4 |
| Irgacure 127 | 1 | 1 | 1 | 1 |
| BYK-UV3570 | 0.2 | 0.2 | 0.2 | 0.2 |
| Irgastab UV10 | 0.2 | 0.2 | 0.2 | 0.2 |
| Pigment Black-7 | 3 | | | |
| Pigment Blue-15:3 | | 3 | | |
| Pigment Violet-19 | | | 3 | |
| Pigment Yellow-213 | | | | 3 |
| Initial Viscosity [mPa · s] | 9.3 | 9.3 | 8.4 | 8.3 |

Preparation of Various Ink Compositions

Preparation of Pigment Dispersion C.I. Pigment Black 7

(Carbon Black) 15 weight % as a coloring material and Allyl glycol (produced by Nippon Nyukazai Co., Ltd.) as a monomer were added so as to make a total of 100 weight %, and were mixed and stirred to prepare a mixture. This mixture was dispersion-processed with zirconia beads (diameter 1.5 mm) for six hours by using a sand mill (produced by Yasukawa Seisakusho).

Thereafter, the zirconia beads were separated by using a separator and Black Pigment dispersion was acquired.

Pigment dispersion corresponding to each color, that is, cyan pigment dispersion 4 (C.I. Pigment Blue 15:3), magenta pigment dispersion (C.I. Pigment Violet-19), and yellow pigment dispersion (C.I. Pigment Yellow 213) were prepared by using the same method as described above.

After various additives according to compositions (weight %) shown in Table 1 were mixed and completely dissolved, the above-described pigment dispersion (Pigment Black-7, Pigment Blue-15:3, Pigment Violet-19, and Pigment Yellow-213) were dropped thereto while being stirred (refer to Table 1 for dropping amounts). After completing the dropping process, the mixture was mixed and stirred for one hour at the normal temperature, and was filtered by a membrane filter of 5 μm again so as to acquire each ink composition.

Used additives in the table are as below.

Allyl Glycol (Monomer: produced by Nippon Nyukazai Co., Ltd.)

U-15HA (urethane oligomer: produced by SHIN-NAKAMURA Chemical Co., Ltd)

Irgacure 819

(photopolymerization initiator: produced by Ciba Specialty Chemicals)

Irgacure 127

(photopolymerization initiator:produced by Ciba Specialty Chemicals)

BYK-UV3570

(surface active agent: produced by BYK Japan KK)

Irgastab UV10

(thermal radical polymerization inhibitor: produced by Ciba Specialty Chemicals)

The above-described ultraviolet curable ink was filled into each nozzle array by using an ink jet printer of PX-G5000 manufactured by SEIKO EPSON Corporation, and a full-color (multiple color) image pattern having a middle-sized diameter of ink dots and a 2.5 μm coating thickness of a printing material was printed on a PET film under normal temperature and normal pressure for each color. In addition, a curing process for the printing material was performed under the following irradiation condition. UVLED inside the ultraviolet ray irradiation device which was installed beside a carriage was disposed as below.

Irradiation Condition

Condition 1

Ultraviolet rays having a wavelength of 365 nm were disposed in the vicinity of the recording head and ultraviolet rays having a wavelength of 395 nm were disposed on the outer side thereof so as to have the irradiation intensity of 60 $mW/cm^2$.

Condition 2

Ultraviolet rays having a wavelength of 395 nm were disposed in the vicinity of the recording head and ultraviolet rays having a wavelength of 365 nm were disposed on the outer side thereof so as to have the irradiation intensity of 60 $mW/cm^2$.

Evaluation of Curing State

Indexes of curing states are as below.

A: cured without blurring or color mixing

B: cured with blurring or color mixing

TABLE 2

| | Experimental Example 1 (Present Invention) | Experimental Example 2 (Comparative Example) |
|---|---|---|
| Irradiation Condition | Condition 1 | Condition 2 |
| Curing State | A | B |

According to the present invention, even in a multiple-color printing process for a case where the viscosity of ink is low and the ink coating is relatively thin, a curing process could be performed without incurring blurring or color mixing.

The disclosure of Japanese Patent Application No. 2007-313612 filed Dec. 4, 2007 including specification, drawings and claims is incorporated herein by reference in its entirety.

The invention claimed is:

1. An ultraviolet ray irradiation device comprising an ultraviolet light source that irradiates ultraviolet rays onto a plurality of ultraviolet curable ink ejected on a recording medium by a record head, and a dividing mechanism comprising two filters, a first filter that passes the ultraviolet light rays of a first group of ultraviolet rays of shorter wavelengths, and a second filter that passes a second group of ultraviolet rays of longer wavelengths, wherein the ultraviolet ray irradiation device comprises a plurality of ultraviolet light sources, wherein an ultraviolet ray of the ultraviolet light source that irradiates the ultraviolet ray onto the recording medium in the vicinity of the record head is an ultraviolet light ray of the first group with a wavelength shorter than an ultraviolet ray of the second group from the ultraviolet light source that irradiates the ultraviolet ray onto the recording medium apart from the vicinity of the record head.

2. The ultraviolet ray irradiation device according to claim 1, wherein the plurality of ultraviolet light sources irradiates ultraviolet rays having wavelengths, which sequentially increase as the ultraviolet light sources are positioned far apart from the vicinity of the record head, onto the recording medium.

3. The ultraviolet ray irradiation device according to claim 1, wherein a reflection mechanism is disposed in a position facing the filter and reflects the ultraviolet rays emitted from the ultraviolet light source to the filter side.

4. The ultraviolet ray irradiation device according to claim 3, wherein the means divides the ultraviolet rays such that the wavelength for transmission sequentially increases as the means is positioned far apart from the vicinity of the record head.

5. The ultraviolet ray irradiation device according to any one of claim 1, wherein the filter divides the ultraviolet rays such that the wavelength for transmission sequentially increases as the means is positioned far apart from the vicinity of the record head.

6. The ultraviolet ray irradiation device according to claim 1, wherein the record head is a line-type head that is provided along the width direction of the recording medium, and wherein an ultraviolet ray of the ultraviolet irradiation light source that irradiates the ultraviolet ray onto the recording medium in the vicinity of the record head has a wavelength shorter than an ultraviolet ray of the ultraviolet irradiation light source that irradiates the ultraviolet ray onto the recording medium apart from the vicinity of the record head along the transport direction of the recording medium.

7. The ultraviolet ray irradiation device according to claim 1, wherein the recording head is a head built in a carriage, and wherein an ultraviolet ray of the ultraviolet irradiation light source that irradiates the ultraviolet ray onto the recording medium in the vicinity of the record head has a wavelength shorter than an ultraviolet ray of the ultraviolet irradiation light source that irradiates the ultraviolet ray onto the recording medium apart from the vicinity of the record head along the moving direction of the carriage.

8. The ultraviolet ray irradiation device according to claim 7, wherein the ultraviolet ray irradiation device is provided on both ends along the moving direction of the carriage.

9. The ultraviolet ray irradiation device according to claim 1, wherein the ultraviolet light source is at least one selected from among an LED, an LD, a mercury lamp, a metal halide lamp, a xenon lamp, and an Excimer lamp.

10. A recording apparatus including the ultraviolet ray irradiation device according to claim 1.

11. The ultraviolet ray irradiation device according to claim 1, wherein the plurality of ultraviolet light sources irradiates ultraviolet rays having wavelengths, which sequentially increase as the ultraviolet light sources are positioned far apart from the vicinity of the record head, onto the recording medium.

12. The ultraviolet ray irradiation device according to claim 1, wherein the means divides the ultraviolet rays such that the wavelength for transmission sequentially increases as the means is positioned far apart from the vicinity of the record head.

13. A method of recording on a recording medium in multiple colors by using a plurality of ultraviolet curable ink, wherein, when the plurality of ultraviolet curable ink ejected on the recording medium from a record head is to be cured, the ultraviolet ray curable ink is cured by irradiating an ultraviolet ray of an ultraviolet light source, passing the ultraviolet ray as either an ultraviolet ray of a short wavelength or a longer wavelength using two filters, a first filter that passes the ultraviolet light rays of a first group of ultraviolet rays of shorter wavelengths, and a second filter that passes a second group of ultraviolet rays of longer wavelengths, wherein an ultraviolet ray of a short wavelength is irradiated on the recording medium in the vicinity of the record head while an ultraviolet ray of a longer wavelength is irradiated onto the recording medium apart from the vicinity of the record head.

* * * * *